US006393990B1

(12) United States Patent
Fagan

(10) Patent No.: US 6,393,990 B1
(45) Date of Patent: May 28, 2002

(54) FIREWORK LAUNCHING SYSTEM AND METHOD

(75) Inventor: Thomas J. Fagan, 5660 Mad River Rd., Dayton, OH (US) 45459

(73) Assignee: Thomas J. Fagan, Dayton, OH (US)

( * ) Notice: Subject to any disclaimer, the term of this patent is extended or adjusted under 35 U.S.C. 154(b) by 0 days.

(21) Appl. No.: 09/535,282

(22) Filed: Mar. 24, 2000

(51) Int. Cl.[7] ..... F42B 4/04; F42B 4/26

(52) U.S. Cl. ..... 102/342; 102/345; 102/351; 102/360; 102/361

(58) Field of Search ..... 102/342, 345, 102/351, 352, 360, 361

(56) References Cited

U.S. PATENT DOCUMENTS

| | | | | |
|---|---|---|---|---|
| 1,922,081 A | | 8/1933 | Driggs, Jr. | 102/21 |
| 4,222,306 A | * | 9/1980 | Maury | 102/342 X |
| 4,641,580 A | | 2/1987 | Ogatsu | 102/217 |
| 4,724,768 A | | 2/1988 | Robinson et al. | 102/349 |
| 4,771,695 A | | 9/1988 | Simpson | 102/343 |
| 5,149,912 A | | 9/1992 | Waidner et al. | 102/343 |
| 5,249,528 A | | 10/1993 | Lee | 102/361 |
| 5,339,741 A | | 8/1994 | Craven et al. | 102/361 |
| 5,415,152 A | | 5/1995 | Adamson et al. | 124/59 |
| 5,429,053 A | | 7/1995 | Walker | 102/217 |
| 5,567,907 A | | 10/1996 | Westfall | 102/344 |
| 5,691,500 A | | 11/1997 | Mancini | 102/361 |
| 5,710,390 A | | 1/1998 | Ofca | 102/275.4 |
| 5,739,459 A | | 4/1998 | LaMura et al. | 102/361 |
| 5,739,462 A | * | 4/1998 | Poor et al. | 102/342 |
| D400,634 S | | 11/1998 | Byers | D22/112 |
| D402,321 S | | 12/1998 | Kirk | D22/112 |
| 5,979,329 A | | 11/1999 | Collar | 102/342 |

OTHER PUBLICATIONS

"Pyromate, Inc., Clearly the System of Choice, The Firing System Designed With the Shooter in Mind", Pyromate, Inc., 270 Old Dublin Road, Peterborough, NH 03458, admitted prior art.

"Array Touch Fire", Advanced Technique Fireworks, 11019 Buckeye Trace, Goshen, KY 40026, Jun. 1999.

"Mighty–Mite Mortars", Mighty–Mite Marketing, Inc., P.O. Box 2646, La Crosse, WI 54602–2645, Sep. 1990.

"NFPA 1123 Code for the Outdoor Display of Fireworks", Copyright 1990 NFPA.

"NFPA 1123 Code for the Outdoor Display of Fireworks", 1989 Edition.

"Fireworks Business—Tentative Interim Amendment to NFPA 1123", published at HC 67, Box, 30, Dingmans Ferry, PA 18328, No. 192, admitted prior art.

* cited by examiner

*Primary Examiner*—Peter A. Nelson
(74) *Attorney, Agent, or Firm*—Jacox, Meckstroth & Jenkins

(57) ABSTRACT

This invention relates to a firing launching system and method which comprises a base having a plurality of apertures. The plurality of apertures receive a plurality of mortars which, in turn, receive a plurality of Pyrotechnic projectiles which may be situated in the plurality of mortars, respectively. The Pyrotechnic projectiles may then be ignited and launched to provide a fireworks display. The base may be a one-piece molded solid construction and provided with the plurality of apertures such that at least two-thirds of each of the plurality of mortars is encased to provide support to a wall of the mortar. The base may be provided with a plurality of apertures having a common diameter for receiving a common size mortar or receiving one of a plurality of sleeves, each having the same outer diameter, but a varying inner diameter to permit the sleeve to receive a different sized mortars. In alternate embodiments, the base may be provided hollow such that it can be filled with an insulator, such as water or sand, at a launch site. In this embodiment, the base can be emptied to facilitate transporting the base to and from the pyrotechnic launch site.

47 Claims, 8 Drawing Sheets

FIREWORK LAUNCHING SYSTEM AND METHOD

BACKGROUND OF THE INVENTION

1. Field of the Invention

This invention relates to a firework launching system and method and, more particularly, to a firework launching system and method which utilizes a one-piece construction base having a plurality of apertures for receiving a plurality of mortars, respectively, which, in turn, receive projectiles for launching at a fireworks show.

2. Description of the Related Art

Pyrotechnic displays, commonly referred to as fireworks or fireworks displays, have been created and enjoyed for centuries by millions of people. Typical systems of prior art for creating fireworks displays include a pyrotechnic projectile and a mortar for launching pyrotechnic projectiles into the air. Typical pyrotechnic projectiles comprise an inner shell with a main burst that detonates in the air and an initial burst enclosed within an outer shell. By manually igniting an initial fuse, the initial burst is exploded and expels the pyrotechnic projectile from the mortar into the air. This explosion, in turn, lights a main fuse which takes a specific time to burn to ignite the main burst into an aerial Pyrotechnic display.

Typical prior art mortars are cylindrical hollow tubes or containers and are constructed of rigid materials, such as cardboard, plastic or metal. This relatively simple mortar construction requires that pyrotechnic projectiles have a specific orientation within the mortar. The orientation provides for the outer shell having the initial burst to be arranged so that it is below the main burst. As mentioned earlier, the initial burst is ignited, it explodes and expels the pyrotechnic projectile from the mortar.

Moreover, existing mortar construction generally is not conducive to adjustment after installation at the launch site.

In some cases, some mortars are arranged in a fixed wood, or metal frame or "rack" arrangement. Some frames enable one or more mortars to be situated side-by-side at a tilted angle so that the Pyrotechnic projectile can be shot at an angle of, for example, between zero and 20 degrees. One such supporting frame or "rack" structure is provided by Advance Technology Firework of Goshen, Ky. 40026.

A problem with the typical frame or "rack" arrangements of the past is that they did not encase a majority of the mortar to facilitate containing the explosion within the mortar and reducing damage to the mortar walls when the pyrotechnic projectile was exploded within the mortar.

Another problem with some rack arrangements of the past is the safety hazard if the frame or "rack" accidentally fell over. If this happened, the pyrotechnic projectiles may be caused to be aimed towards people, such as people in an audience at a fireworks display show.

What is needed, therefore, is a system and method for eliminating or minimizing these problems, while providing a unique system and method which facilitates launching a plurality of pyrotechnic projectiles at a fireworks display show.

SUMMARY OF THE INVENTION

It is a primary object of the invention, therefore, to provide a system and method of improving the ability to launch pyrotechnic projectiles.

Another object of the invention is to provide a system and method which utilizes a base comprising an integral one-piece or multi-piece combined construction and having a plurality of apertures which receive and support a plurality of mortars, respectively.

Another object of the invention is to provide a pyrotechnic projectile base having a plurality of apertures of different diameters for receiving a plurality of different size mortars, respectively.

Still another object of the invention is to provide a base having a common aperture size, but which is capable of receiving either a steel or high density mortar sleeve which, in turn, receives a mortar shell or one of a plurality of mortars each having a common outside diameter, but differing inside diameters so that they are capable of receiving different size projectiles.

Yet another object of the invention is to provide a base which may be a one-piece integral or multi-peace interconnected base construction, and the base may be a hollow construction for receiving a support insulator such as a fluid (e.g., water) or a solid (e.g., sand).

In one aspect, this invention comprises a firework launching system comprising a base having a plurality of apertures, a plurality of mortars for removably situating in the plurality of apertures, the plurality of mortars being capable of receiving a plurality of projectiles, respectively, each of the plurality of mortars comprising a length, the base being a one-piece molded construction encasing at least two-thirds and up to 100 percent of the length when the plurality of mortars are situated in the plurality of apertures.

In another aspect, this invention comprises a firework launching method comprising the steps of providing a base having a plurality of apertures and providing a plurality of mortars for situating in a plurality of apertures, the plurality of mortars being capable of receiving a plurality of projectiles, the one-piece molded construction base encasing at least two-thirds of the length when said plurality of mortars are situated in a plurality of apertures.

In yet another aspect, this invention comprises a firework launching system comprising a base having a plurality of apertures for receiving a plurality of mortars, a plurality of mortars being capable of receiving a plurality of projectiles, the base encasing at least two-thirds of the length when a plurality of mortars ale situated in a plurality of apertures.

BRIEF DESCRIPTION OF ACCOMPANYING DRAWINGS

DETAILED DESCRIPTION OF THE PREFERRED EMBODIMENTS

Figure 1:
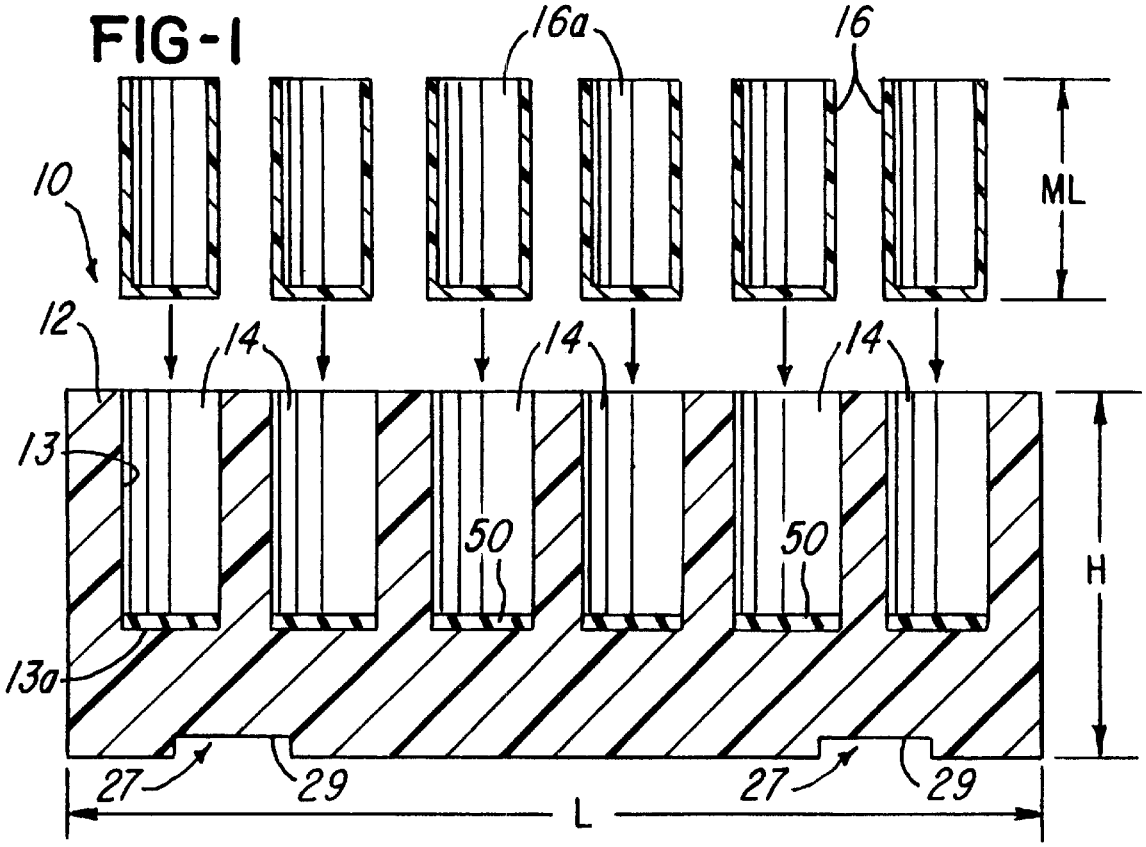
FIG. 1 is a sectional view of a launching system according to one embodiment of the invention, wherein a plurality of mortars are situated above a base.
Figure 11:
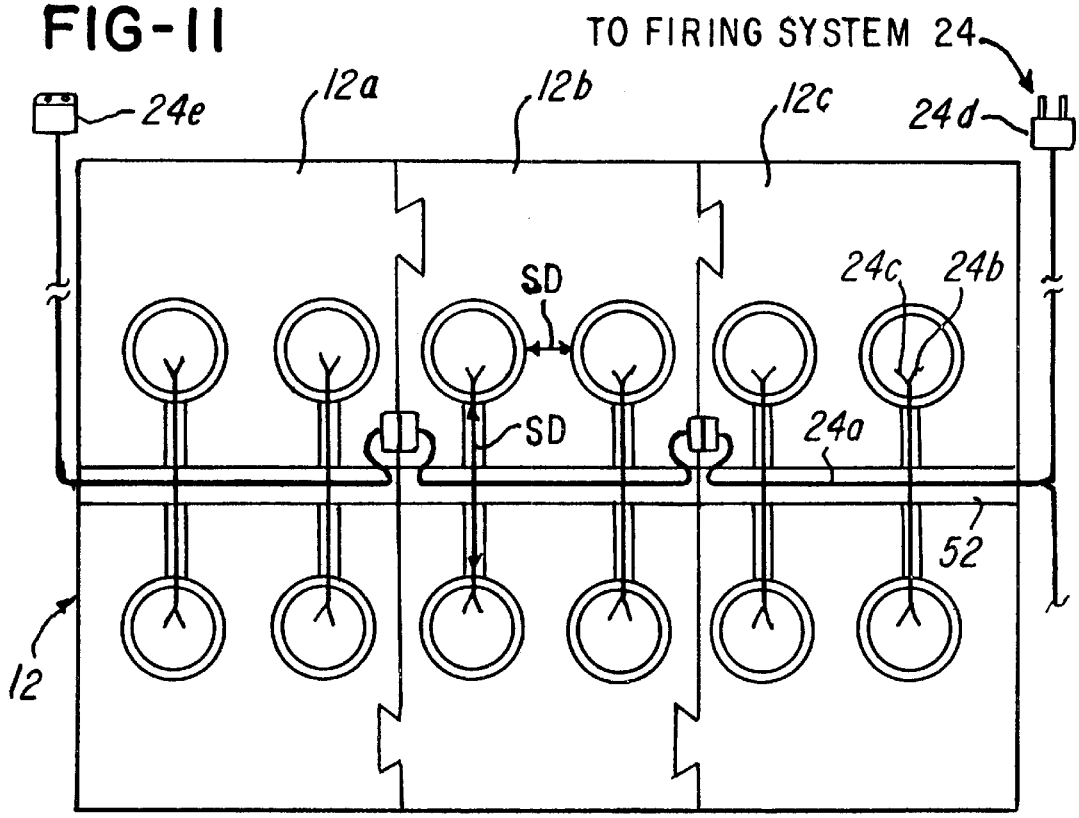
FIG. 11 is a view of another embodiment showing a multi-piece construction showing a base comprised of multiple sections.

Referring now to FIG. 1, a firework launching system 10 is shown. The firework launching system 10 comprises a base 12 having a plurality of generally cylindrical apertures 14. In the embodiment being described, the base 12 is an integral one-piece plastic molded construction and the mortars 16 are also plastic. It should be noted that the plurality of apertures 14 are defined by a plurality of interior surfaces 13 each comprising an end or end surface 13*a* defined by the base 12 which is defined by the base. Alternatively, as shown in FIG. 11, the base 12 may be a multi-piece construction having multiple sections 12*a*–12*c*. These sections 12*a*–12*c* include an interlocking means or lock, such as a puzzle shape so that the sections can be interlocked which enhances stability of the base 12. In the embodiment being described, the plastic may be comprised of a high density polyethylene (HDPE), fiberglass or other suitable composite construction.

Figure 3:
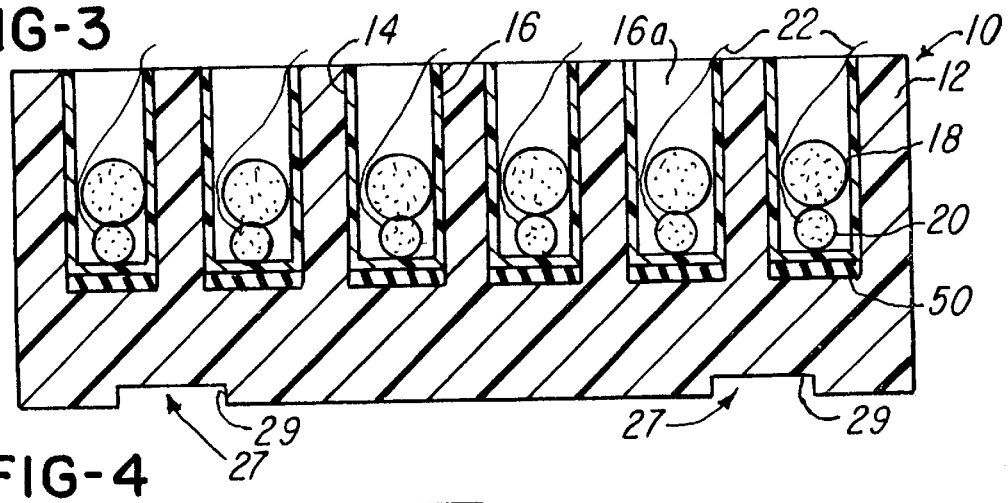
FIG. 3 is a sectional view similar to FIG. 2 showing the projectiles situated in the mortars.

The system may optionally comprise a plurality of mortars 16 which are removably received and situated in the plurality of apertures 14, respectively, as illustrated in FIG. 3. Each of the mortars 16 comprises a mortar length ML (FIG. 1) which is on the order of about 24 inches to 38 inches. In the embodiment being described, the plurality of mortars 16 typically comprise a diameter of at least 3 inches. Also, it is not uncommon that the diameter of each cylindrical mortar 16 does not exceed 16 inches. In the embodiment being described, the plurality of apertures 14 in base 12 receive the plurality ot mortars 16, respectively, such that at least two-thirds (or at least 66 percent) of the length ML is encased by base 12, and it should be appreciated that such percentage can be as much as 100 percent. In the embodiment being described, the mortars 16 may be comprised of steel, composite material, such as plastic or fiberglass, or even paper.

Figure 14:
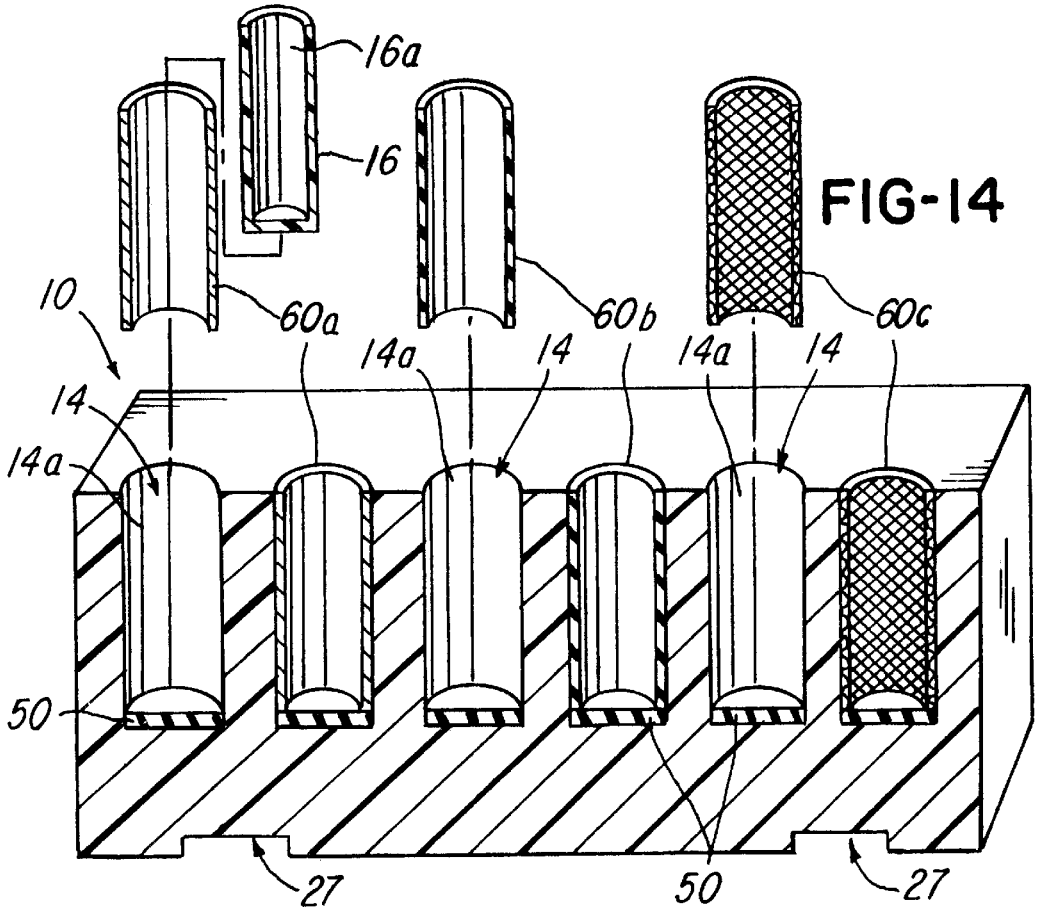
FIG. 14 is a view showing a protective sleeve used with the mortar.

As best shown in FIG. 14, the system 10 may further optionally comprise a protective sleeve 60 in the form of metal (60*a*), rubber (60*b*) or wire mesh (60*c*). The sleeve 60 facilitates protecting an inner wall 14*a* of aperture 14 during an explosion, thereby prolonging the useful life of the base 12.

As illustrated in FIG. 1, the plurality of apertures 14 optionally include a plurality of rubber inserts 50 that facilitate cushioning the shock of the explosion in the apertures 14 or in the mortars 16 if they are used.

Figure 2:
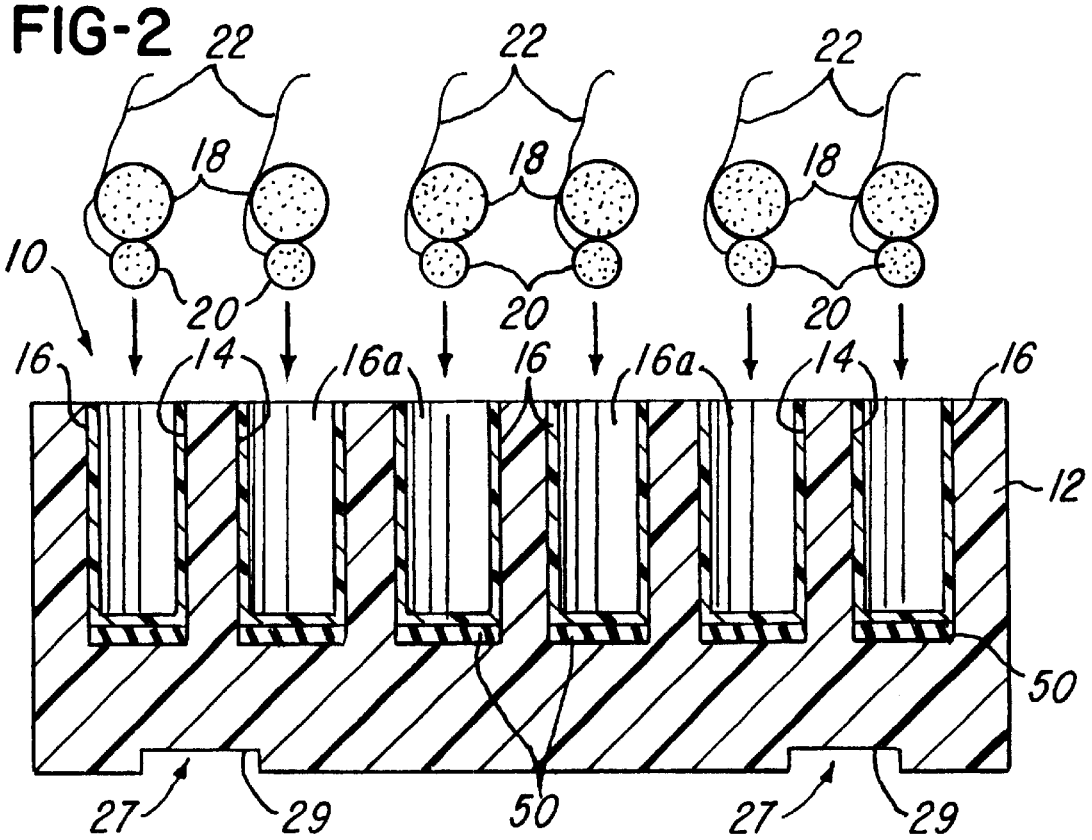
FIG. 2 is a sectional view showing the mortars shown in FIG. 1 situated in the base and further showing a plurality of projectiles for receipt in the apertures defined by the mortars.

As best illustrated in FIGS. 2 and 3, after the mortars 16 are situated in the apertures 14 of base 12, a projectile 18 having a charge 20 with a fuse 22 are situated in the cylindrical apertures 16*a* defined by each mortar 16. After the projectiles 18 are situated in apertures 16*a,* the fuses 22 may be lit (manually or electronically as provided herein) to launch the projectiles 18 and to provide a fireworks display. The mortars 16 may be purchased from Unreal Effects, Inc. of Strathmore, Alberta, Canada.

Figure 4:
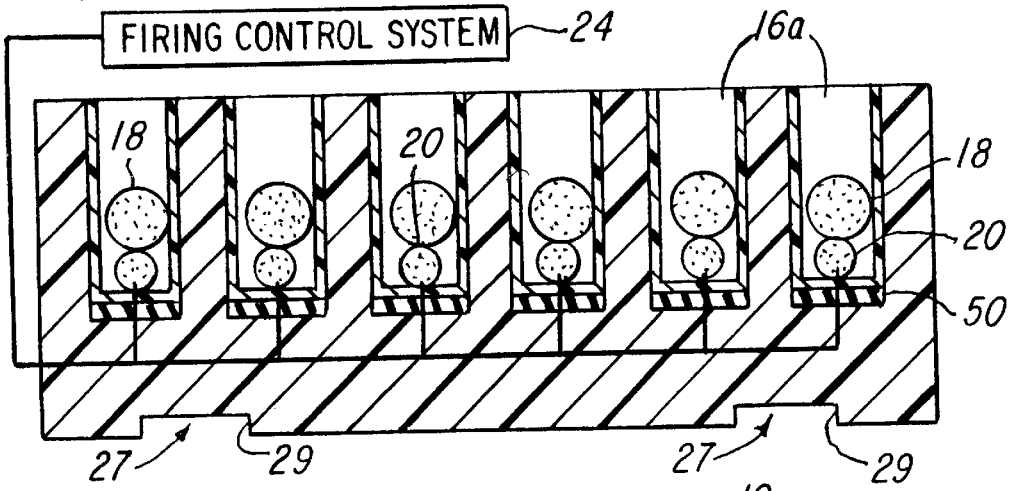
FIG. 4 is a sectional view similar to FIG. 3, illustrating an alternative electronic firing control system for igniting a charge associated with the projectiles.

As best illustrated in FIG. 4, the firework launching system 10 may comprise electronic means or an electronic firing system 24 for electronically igniting the charge 20 in accordance with a computer program (not shown) which may be pre-programmed by a user. One suitable firing control system 24 may be the Pyromate system available from Pyromate, Inc. of Peterborough, N.H. 03458. Other suitable system is the Array Touch Fire system available from Advance Technique Fireworks of Goshen, Ky. Other suitable electronic firing systems may include the Fire One Digital Firing System available from Pyrotechnics Management, Inc. of St. College, Pa.; the Pyromate available from Pyromate, Inc., of Peterborough, N.H.; or the MP-20B system available from Dellcor Industries, Inc. of Yonkers, N.Y.

Figure 12A:
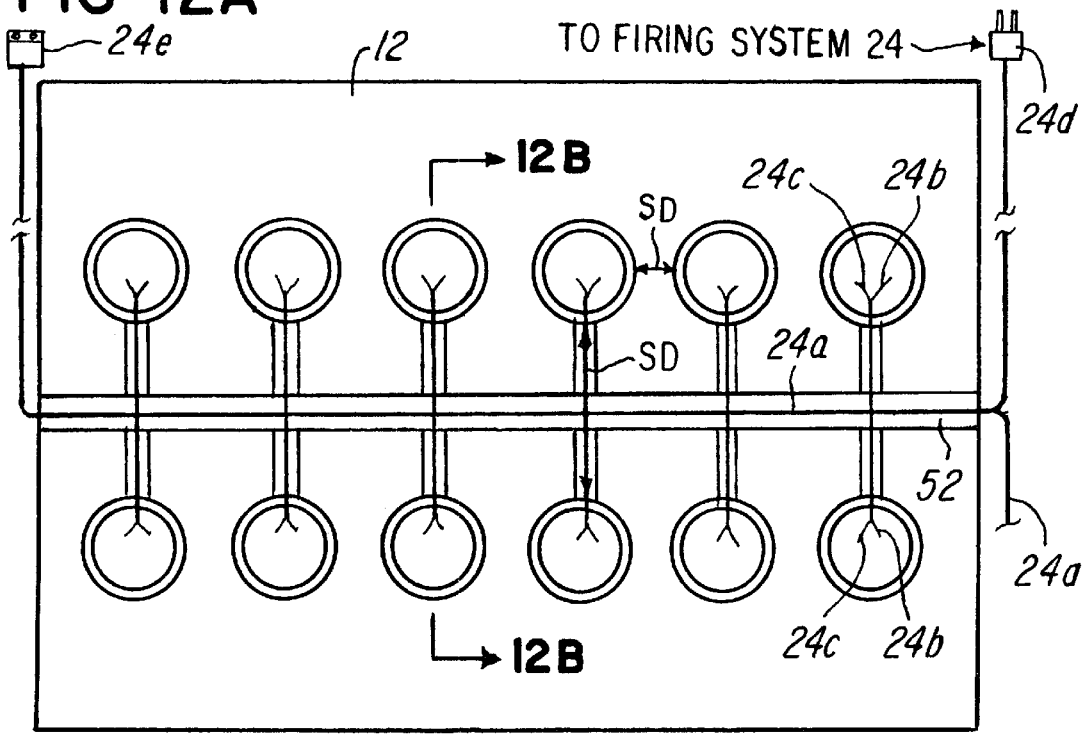
FIGS. 12A and 12B are views of the embodiment shown in FIG. 8, illustrating an electronic firing system situated in a channel of the base.
Figure 12B:
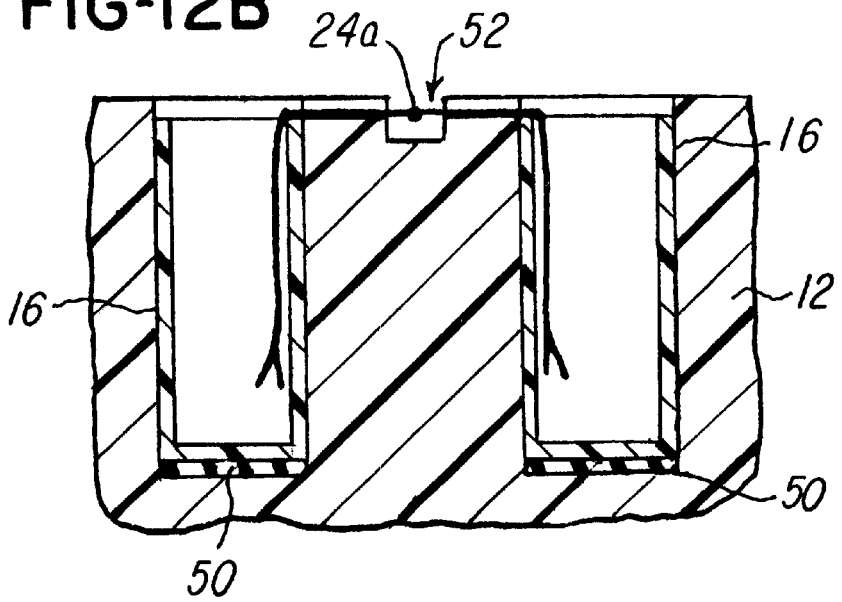

As best illustrated in FIG. 12, the electronic firing system 24 may be integrally formed or situated in said base 12. For example, the electronic firing system may comprise wires 24*a* having electrodes 24*b* and 24*c* which couple the fuses 22 to the control system 24. Note that the wires 24*a* may be integrally formed into the base 12 (FIG. 4) or they may lie in recess channels 52 (FIGS. 12A and 12B) formed, manufactured or molded into the base 12.

It should be appreciated that the electronic firing system 24 provides means for "chaining" or serially connecting a plurality of bases 12, each having a plurality of mortars 16, together and under the computer control of the electronic firing system 24. This permits, for example, sequence firing and using bases 12 having different size mortars 12. As shown in FIG. 12, for example, the wires 24*a* may each have a male connector 24*d* and a female connector 24*e* for coupling to an electronic firing system 24 in an adjacent base 12.

To facilitate coupling the bases 12, they could have a locking arrangement, such as a dove-tail and groove configuration (FIG. 11), to permit multiple bases 12 to be coupled together as shown in FIG. 11.

Figure 5:
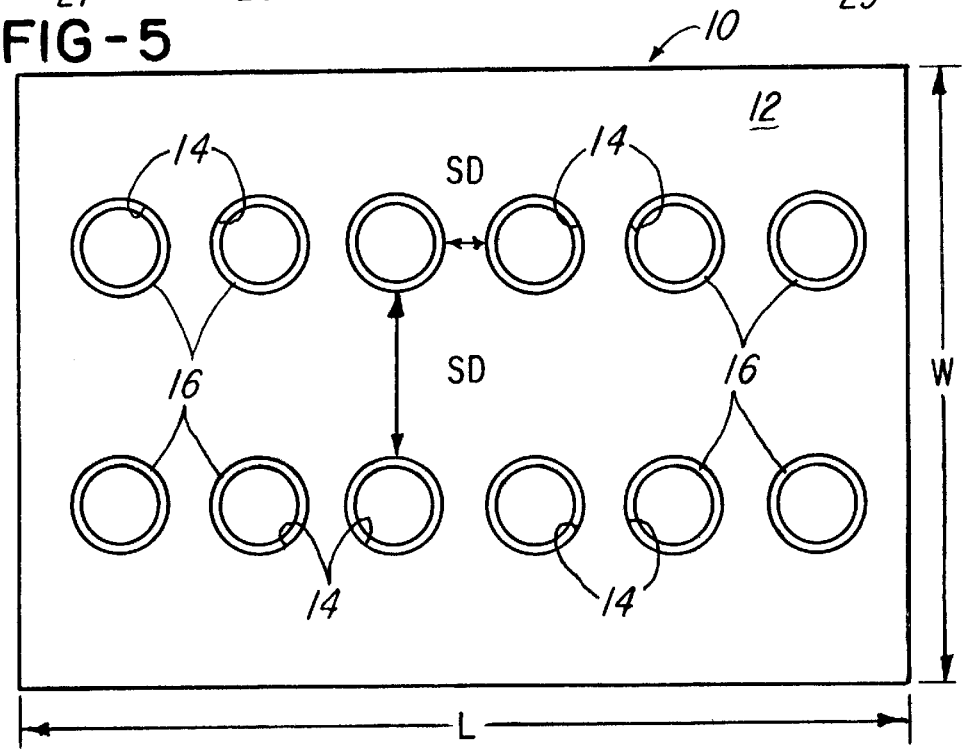
FIG. 5 is a plan view of the base showing a plurality of mortars situated in the apertures, with the mortars having a common diameter.

In the embodiment being described, it is envisioned that the height H (FIG. 1) is on the order of about 24–28 inches and a length L of 6–10 feet. The base 12 may also comprise a width W (FIG. 5) of about 5–8 feet. In the embodiment being described, the base 12 may be situated on a mobile trailer (not shown) which can be trailered to a firework display launch site. Also, as best illustrated in FIGS. 1–3, the base 12 may be provided or formed with channels 27 to define with forklift lifting apertures 29 to facilitate lifting the base 12 with a forklift truck (not shown).

Figure 6:
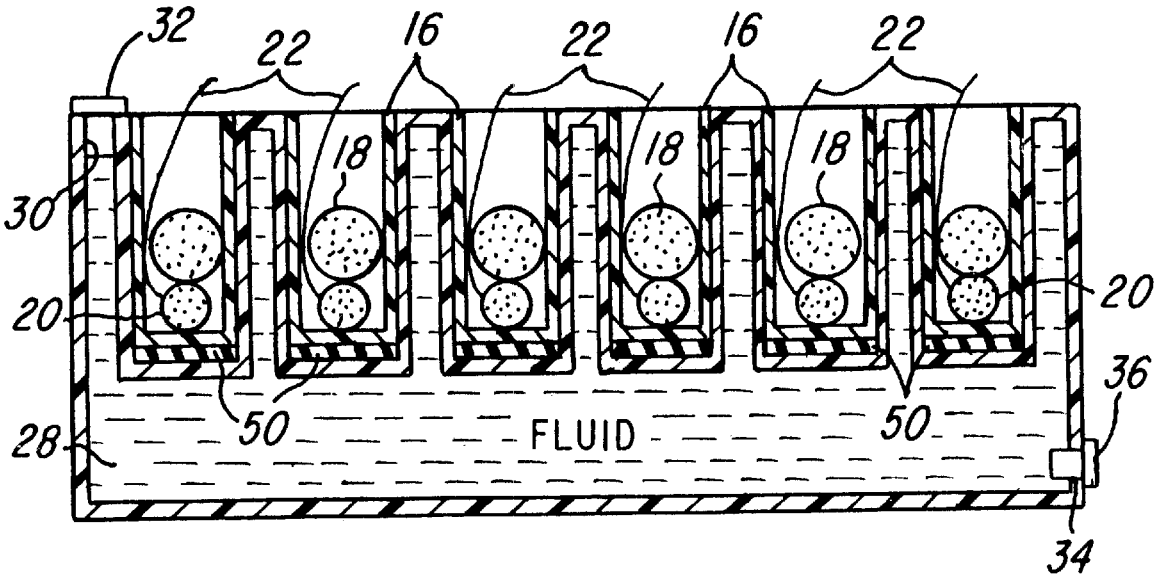
FIG. 6 is a view similar to FIG. 3 showing a hollow base for receiving an insulator, such as a fluid.
Figure 7:
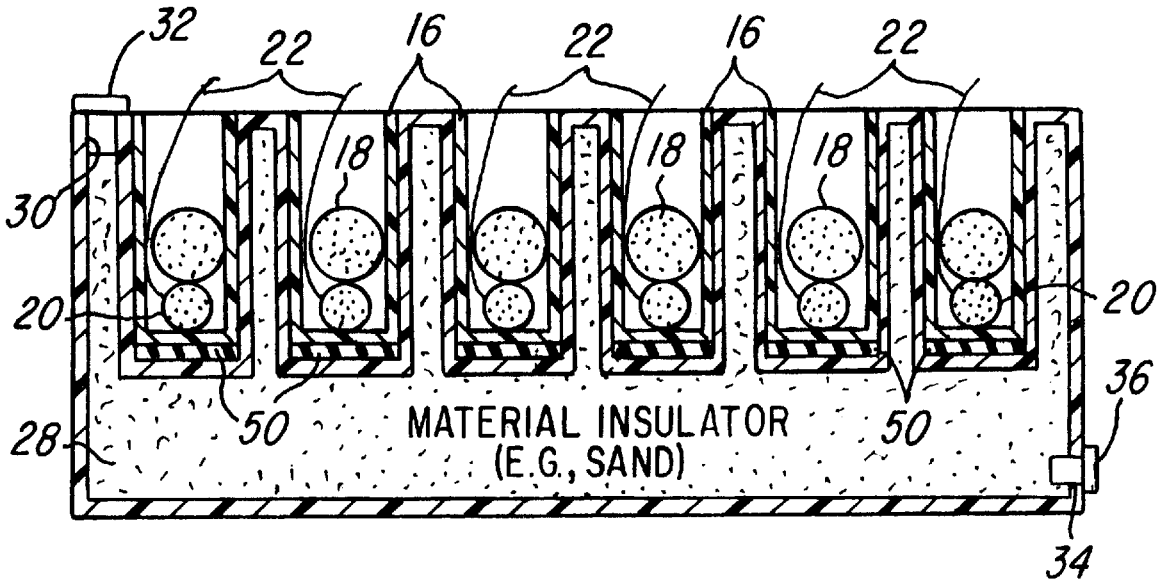
FIG. 7 is a view similar to FIG. 3 showing a hollow base for receiving a material insulator, such as sand.

Although the embodiment shown in FIGS. 1–3 and 11 show the base 12 being a solid one-piece construction, the base 12 may be provided with a hollow interior cavity 28 for receiving either a fluid (FIG. 6), such as water, or another material insulator, such as sand. In this regard, the base comprises an opening 30 sealed with a cap 32 and a drain opening 34 sealed with a drain cap 36. The hollow aperture or cavity 28 and caps 32 and 36 enable the base 12 to be filled and emptied for transporting to and from a fireworks display launch site. The plurality of mortars 16 may be formed of metal, plastic, fiberglass or other suitable composite material.

Figure 8:
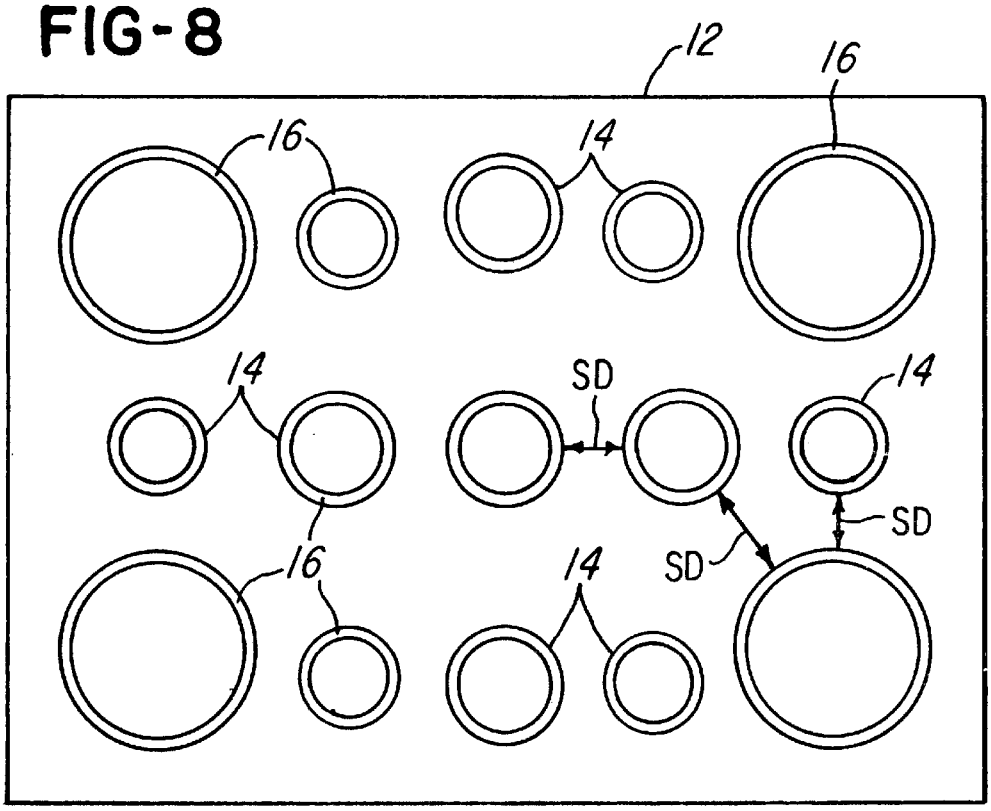
FIG. 8 is a plan view illustrating another embodiment of the invention wherein the apertures have varying sizes for receiving varying sized mortars or sleeves for mortars, respectively.

As best illustrated in FIG. 8, the base 12 may be provided with a plurality of apertures 14 having different sizes so that different size mortars 16 may be situated in the base 12, thereby permitting a user to launch a variety of different sized projectiles 18.

Figure 9:
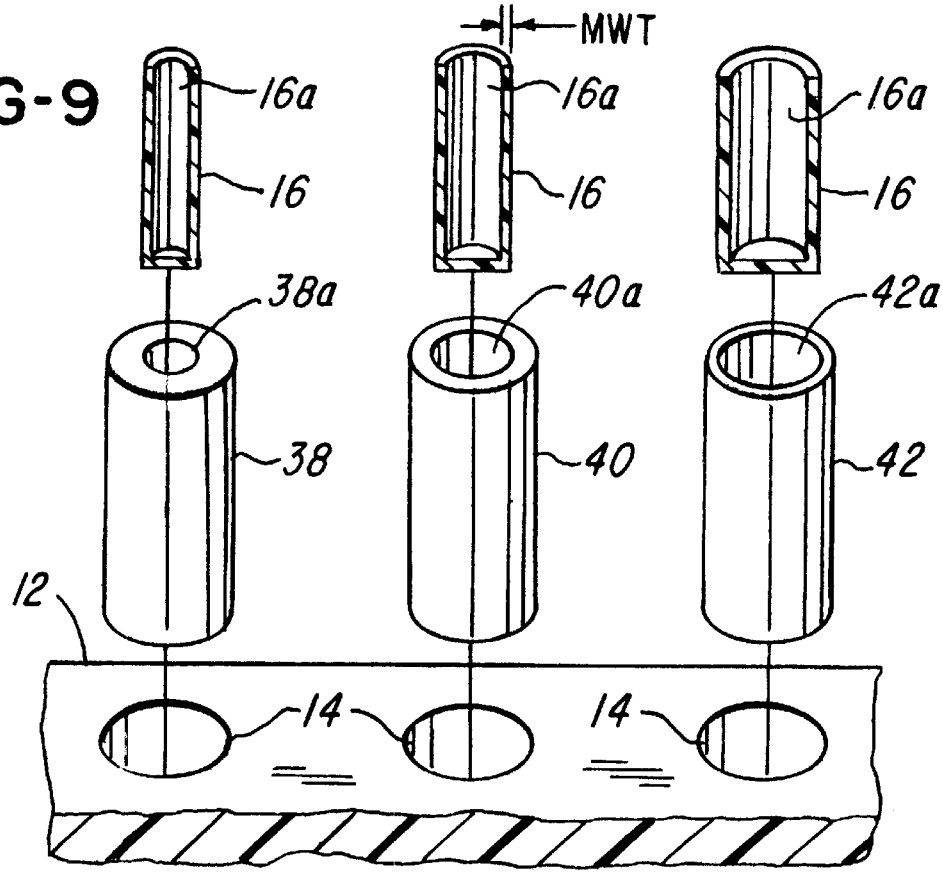
FIG. 9 is a fragmentary view of another embodiment of the invention showing a plurality of mortar sleeves for receipt in the apertures in base and which, in turn, receive a plurality of mortars, respectively, of varying sizes.

As best illustrated in FIG. 9, it is also envisioned that a base 12 may be provided with a plurality of apertures 14 having a common diameter and capable of receiving one of a plurality of sleeves 38, 40 and 42 (FIG. 9) which have a common outside diameter. As illustrated, the sleeves 38, 40 and 42 define different inside diameters for receiving mortars 16 of varying sizes. For example, notice in FIG. 9 that the sleeves 38, 40 and 42 each have inside diameters for receiving three different size mortars 16, such as mortars having diameters of three inch, four inch and fives inch, respectively. This facilitates providing the base 12 capable of receiving a variety of different mortars 16.

Although not shown, it is envisioned that the mortars 16 themselves may be provided with a wall thickness MWT (FIG. 9) which is thick enough to permit them to be received directly in the apertures 14. This would, in turn, eliminate the need for using the sleeves 38, 40 and 42. Thus, each different size mortar 16 would have a defined wall thickness which would permit the mortar 16 to removably fit into the common size apertures 14 shown in FIGS. 5 and 9, with the fit being loose enough to maximize the mortar 16 to absorb the shock of any explosion.

In the embodiment being described, the apertures 14 are separated by a separation distance SD (FIGS. 5 and 8) between adjacent apertures 14 of at least as great as a diameter of either of the adjacent mortars. This defined separation distance facilitates mandating compliance with various standards established by the National Fire Protection Association regulations.

Although not shown, it is also envisioned that the apertures 14 may be provided or formed in said base 12 so that they are on an angle between zero and 50 degrees relative to the ground or a bottom 12*a* (FIG. 1) of the base 12. This facilitates launching the projectiles 18 at various angles (not shown) relative to the ground. For example, the base 12 could be provided with some cylindrical apertures 14 provided in the base 12 at a first angle, such as ten degrees, and another set of apertures 14 situated in the base 12 at another angle, such as 15 degrees, and yet another set of apertures 14 situated at a third an angle, such as 20 degrees, in order to provide a user with a wide variety of launch angle capabilities.

Figure 10A:
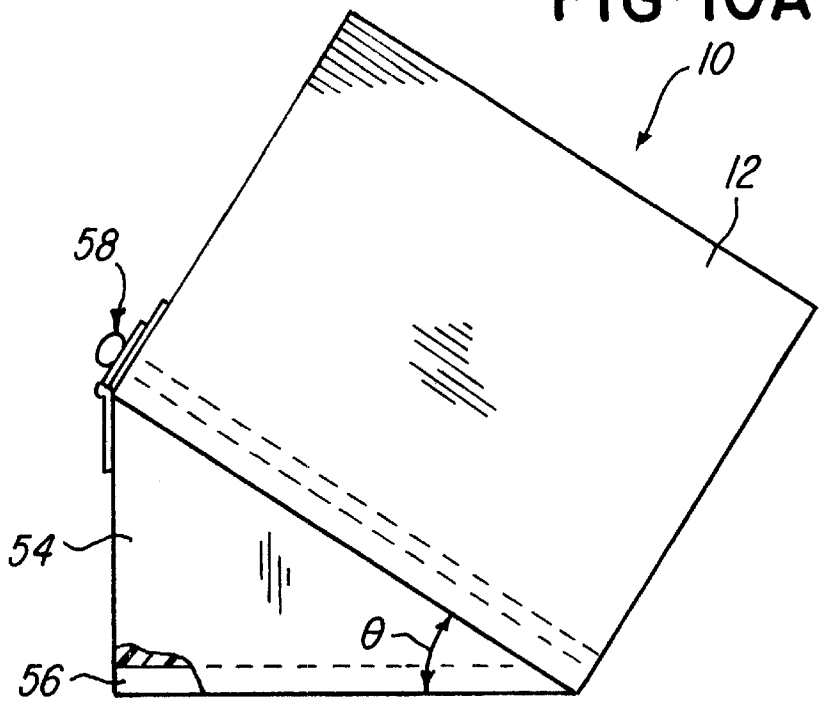
FIGS. 10A and 10B are a views of another embodiment showing a tilting wedge with locks for use with the base.
Figure 10B:
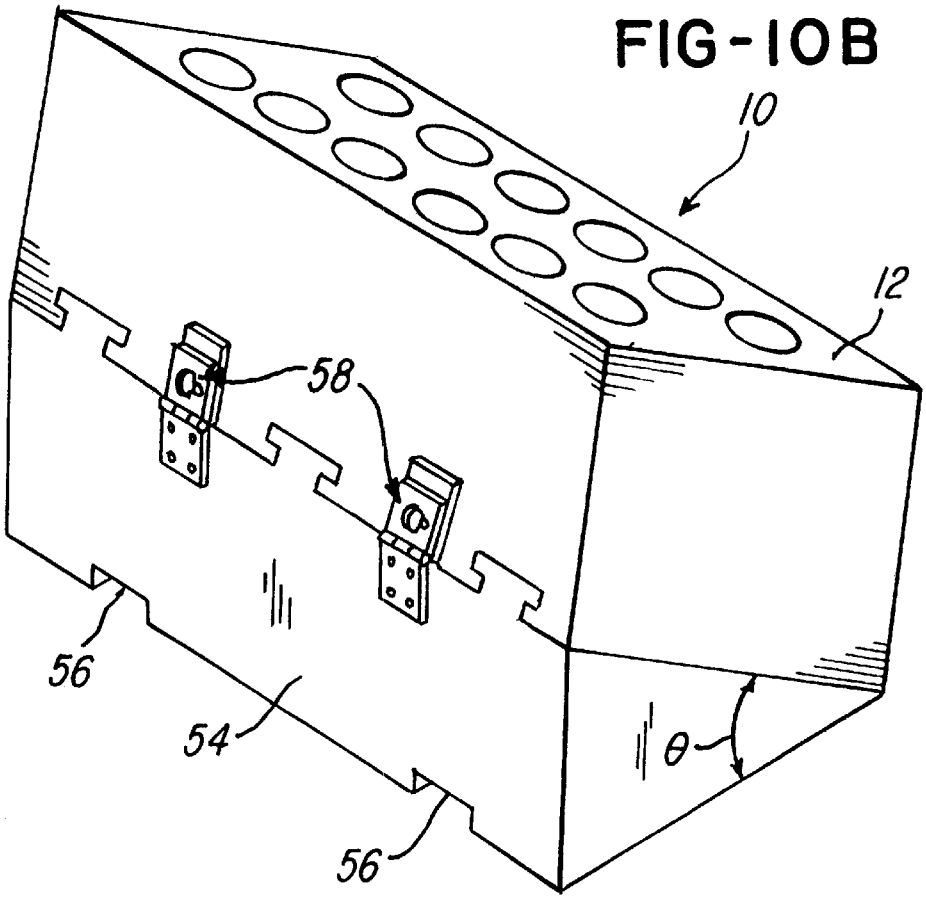

FIG. 10 illustrates another embodiment of the system 10 comprising a tilting wedge 54 which may be used with the base 12. The tilting wedge 54 facilitates tilting the base 12 to a desired angle θ so that the projectiles 18 can be launched at a desired angle. In the embodiment being described, the tilting wedge 54 may facilitate tilting the base 12 at an angle of at least 10 degrees. Although not shown, the wedge 54 may be constructed to be adjustable to facilitate tilting the base 12 at many different angles.

Note that the tilting wedge 54 comprises the fork lift slots 56 whose function is similar to the function of the slots 29 mentioned earlier herein. The wedge 54 and base 12 may also have a dovetail and groove configuration so that the wedge 54 is situated properly and removably to the base 12. Additionally, the wedge 54 may comprise a lock 58 for locking the wedge 54 onto the base 12. A method of operation of the firework launching system will now be described.

First, the base 12 (FIG. 1) having the plurality of apertures 14 is provided to receive the plurality of mortars 16, unless a user wishes to use the base without the mortars 16. Depending on the embodiment being described, the sleeves 38, 40 and 42 (FIG. 9) may be provided or mortars 16 having varying wall thicknesses may be provided for receipt in the commonly shaped apertures 14, as described above. Alternatively, a base of the type illustrated in FIG. 8 may be provided and mortars 16 having various sized outside diameters may be used to enable a user to launch varying sized projectiles 18. The plurality of inserts 50 are situated in the aperture 14 or mortars 16 (if they are used). After the mortars 16 are removably received in the apertures 14 (or the sleeves 38, 40 and 42 are placed in the apertures 14), the mortars 16 are placed within the sleeve openings 38*a*, 40*a* and 42*a*. The mortar apertures 16*a* are then ready to receive the projectile 18, charge 20 and fuse 22.

Figure 13:
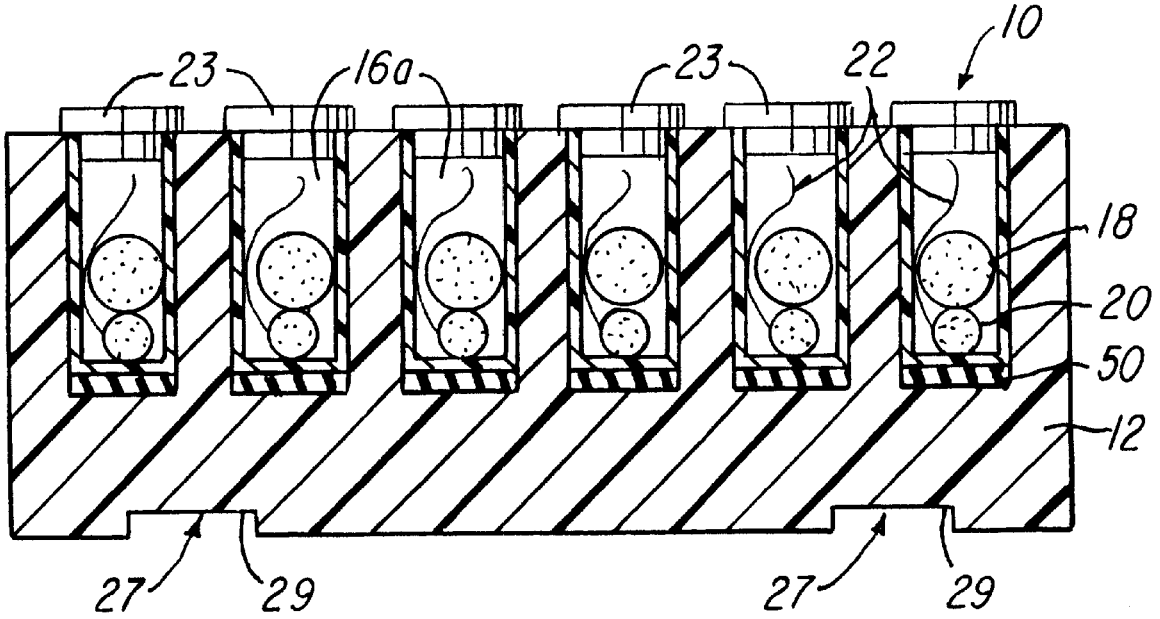
FIG. 13 is a view showing a plurality of caps for sealing and protecting the apertures.

The system 10 may include a plurality of caps 23 (FIG. 13) for placing on the opening 16*a* in order to seal the mortar aperture 16*a*, for example, during transport to a fireworks launch site or to seal the apertures from rain and the like. Preferably, the caps 23 are non-reflective.

Figure 15:
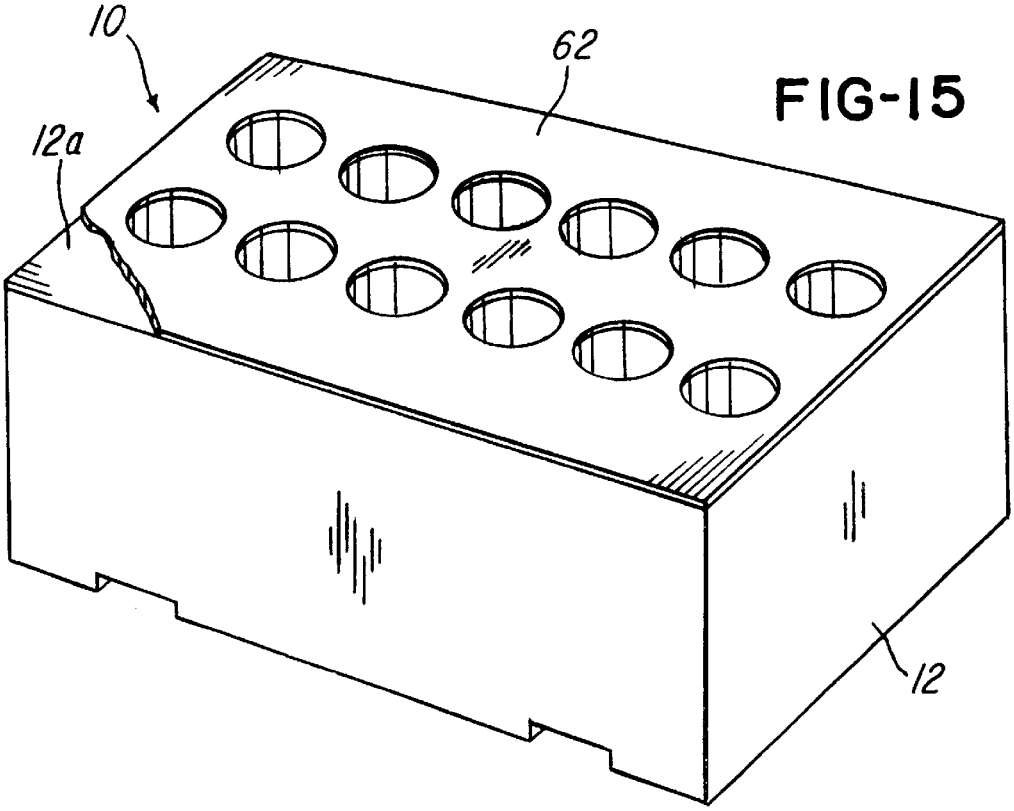
FIG. 15 is a view showing a protective top for protecting a top surface of the base.

Also, as shown in FIG. 15, the system 10 may further comprise a protective or fire-resistant top 62 which is preferably non-reflective and which comprises a thickness of at least 1/16 inch. This top 62 facilitates protecting a top surface 12*a* of base 12 during and after the launching of the projectiles 18.

Once the projectile 18 is situated in the aperture 16*a*, the fuse 22 may be lit (either manually or electronically by the electronic firing system 24 described earlier) to ultimately launch and ignite the projectile 18 in order to provide the fireworks display.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. A firework launching system comprising:

a base; said base comprising a one-piece molded construction comprising a plurality of interior surfaces defining a plurality of apertures, respectively, each of said plurality of interior surfaces comprising an end defined by said base;

a plurality of mortars for removably situating in said plurality of apertures, said plurality of mortars being capable of receiving a plurality of projectiles, respectively, each of said plurality of mortars comprising a length so that when said plurality of mortars are received in said plurality of apertures, respectively, at least two-thirds of said length is encased by said interior surface.

2. The firework launching system as recited in claim 1 wherein said mortars comprise a diameter of at least 2 inches and not more than 16 inches.

3. The firework launching system as recited in claim 1 wherein said base is an one-piece molded construction base integrally formed of plastic or fiberglass.

4. The firework launching system as recited in claim 1 wherein said base comprises an insulation storage area for storing an insulator.

5. A firework launching system comprising:

a base having a plurality of apertures;

a plurality of mortars for removably situating in said plurality of apertures, said plurality of mortars being capable of receiving a plurality of projectiles, respectively, each of said plurality of mortars comprising a length;

said base being a one-piece molded constriction encasing at least two-thirds of said length when said plurality of mortars are situated in said plurality of apertures;

said base comprises an insulation storage area for storing an insulator; and wherein said insulator is water.

6. The firework launching system as recited in claim 4 wherein said insulator is sand.

7. The firework launching system as recited in claim 1 wherein each of said plurality of mortars comprises a plastic or fiberglass shell.

8. The firework launching system as recited in claim 1 wherein said launching system comprises a firing control system for selectively firing said plurality of projectiles.

9. The firework launching system as recited in claim 1 wherein said plurality of apertures are arranged such that a separation distance between adjacent apertures shall be at least as great as a diameter of one of said plurality of mortars.

10. The firework launching system as recited in claim 1 wherein said plurality of apertures are arranged such that a separation distance between adjacent apertures shall be at least as great as a diameter of one of said plurality of mortars.

11. The firework launching system as recited in claim 1 wherein said plurality of apertures are the same diameter.

12. The firework launching system as recited in claim 1 wherein said plurality of apertures are not the same diameter.

13. The firework launching system as recited in claim 1 wherein said system further comprises a plurality of sleeves for situating in said plurality of apertures, said plurality of sleeves being capable of receiving said plurality of mortars.

14. The firework launching system as recited in claim 1 wherein a plurality of said plurality of mortars are situated at an angle between 0 and 50 degrees relative to the ground when said plurality of mortars are placing in said plurality of apertures.

15. A firework launching method comprising the steps of:

providing a base having a plurality of apertures; and providing a plurality of mortars for situating in said plurality of apertures, said plurality of mortars being capable of receiving a plurality of projectiles;

said one-piece molded construction base encasing at least two-thirds percent of said length when said plurality of mortars are situated in said plurality of apertures.

16. The firework launching method as recited in claim 15 wherein method further comprises the step of:

providing said plurality of mortars comprising a diameter of at least 2 inches and not more than 16 inches.

17. The firework launching method as recited in claim 15 wherein said method further comprises the step of:

providing said base which is an one-piece molded construction base integrally formed of plastic or fiberglass.

18. The firework launching method as recited in claim 15 wherein said method further comprises the step of:

providing said base comprising a insulation storage area for storing an insulator.

19. The firework launching method as recited in claim 15 wherein said method further comprises the step of:

enabling a user to fill said base with water.

20. The firework launching method as recited in claim 15 wherein said method further comprises the step of:

enabling a user to fill said base with sand.

21. The firework launching method as recited in claim 15 wherein said method further comprises the step of:

providing each of said plurality of mortars in the form of a plastic or fiberglass shell.

22. The firework launching method as recited in claim 15 wherein said launching method comprises the step of:

providing a firing control system for selectively firing said plurality of projectiles.

23. The firework launching method as recited in claim 15 wherein said method comprises the step of:

providing a base wherein said plurality of apertures are arranged such that a separation distance between adjacent apertures shall be at least as great as a diameter of one of said plurality of mortars.

24. The firework launching method as recited in claim 15 wherein said method further comprises the step of:

providing a base wherein said plurality of apertures are arranged such that a separation distance between adjacent apertures shall be at least as great as a diameter of one of said plurality of mortars.

25. The firework launching method as recited in claim 15 wherein said plurality of apertures are the same diameter.

26. The firework launching method as recited in claim 15 wherein said plurality of apertures are not the same diameter.

27. The firework launching method as recited in claim 15 wherein said method further comprises the steps of:

providing a plurality of sleeves for situating in said plurality of apertures, said plurality of sleeves being capable of receiving said plurality of mortars.

28. A firework launching system comprising:

a base having a plurality of interior surfaces that define a plurality of apertures, each of said plurality of apertures being capable of removeably receiving a mortar; said base comprising a one-piece molded construction and each of said plurality of interior surfaces comprising an end surface defined by said base;

said base encasing at least two-thirds of said length when said plurality of mortars are situated in said plurality of apertures.

29. The firework launching system as recited in claim 28 wherein said mortars comprise a diameter of at least 2 inches and not more than 16 inches.

30. The firework launching system as recited in claim 28 wherein said base is an one-piece molded construction base integrally formed of plastic or fiberglass.

31. The firework launching system as recited in claim 28 wherein said base comprises a insulation storage area for storing an insulator.

32. The firework launching system as recited in claim 28 wherein said launching system comprises a firing control system for selectively firing said plurality of projectiles.

33. The firework launching system as recited in claim 28 wherein said plurality of apertures are arranged such that a separation distance between adjacent apertures shall be at least as great as a diameter of one of said plurality of mortars.

34. The firework launching system as recited in claim 28 wherein said plurality of apertures are not the same diameter.

35. The firework launching system as recited in claim 28 wherein said system further comprises a plurality of sleeves for situating in said plurality of apertures, said plurality of sleeves being capable of receiving said plurality of mortars.

36. The firework launching system as recited in claim 28 wherein said base encases at least 75 percent of said length.

37. The firework launching system as recited in claim 28 wherein said system further comprises at least one protective sleeve.

38. The firework launching system as recited in claim 37 wherein said at least one protective sleeve comprises a wire mesh sleeve, a rubber sleeve or a metal sleeve.

39. The firework launching system as recited in claim 28 wherein said base comprises a top for protecting a top surface of said base.

40. The firework launching system as recited in claim 28 wherein said launching system further comprises a plurality of caps for sealing said apertures.

41. The firework launching system as recited in claim 28 wherein said system further comprises a tilting wedge for tilting said base to a predetermined angle.

42. The firework launching system as recited in claim 41 wherein said tilting wedge comprises a lock for locking said base to said tilting wedge.

43. The firework launching system as recited in claim 41 wherein said tilting wedge is adjustable.

44. A firework launching system comprising:

an integral molded base comprising a plurality of interior surfaces that define a plurality of apertures;

said base comprising a one-piece molded construction and each of said plurality interior surfaces being integral and comprising an end surface defined by said base.

45. The firework launching system as recited in claim 28 wherein said system comprises a plurality of mortars placed in said plurality of apertures, with said mortars comprising a diameter of at least 2 inches and not more than 16 inches.

46. The firework launching system as recited in claim 28 wherein said base is a one-piece molded construction integrally formed of plastic or fiberglass.

47. The firework launching system as recited in claim 28 wherein said plurality of apertures are not of the same diameter.

* * * * *